US005401150A

United States Patent [19]

Brown

[11] Patent Number: 5,401,150

[45] Date of Patent: Mar. 28, 1995

[54] NOISE REDUCED LIQUID SEALED COMPRESSOR

[75] Inventor: Jeffrey M. Brown, Windham, Me.

[73] Assignee: General Signal Corporation, Stamford, Conn.

[21] Appl. No.: 202,378

[22] Filed: Feb. 28, 1994

[51] Int. Cl.[6] ..... F04C 25/00

[52] U.S. Cl. ..... 418/181

[58] Field of Search ..... 418/181; 181/229, 403

[56] References Cited

U.S. PATENT DOCUMENTS 4,109,751 8/1978 Rabele ..... 181/229

FOREIGN PATENT DOCUMENTS 533262 9/1955 Italy ..... 181/229

0079896 4/1986 Japan ..... 418/181

OTHER PUBLICATIONS

Halliday and Resnick, Fundamentals of Physics, 2nd Ed., John Wiley & Sons, 1981, p. 324.

*Primary Examiner*—Richard A. Bertsch
*Assistant Examiner*—Charles G. Freay
*Attorney, Agent, or Firm*—Ohlandt, Greeley & Ruggiero

[57] ABSTRACT

A low noise compressor is realized, involving a port and manifold assembly, and in which a reactive silencer means is formed integrally within the assembly and coupled acoustically with at least one of the input and output manifolds, the silencer including a pair of resonant cavities configured so as to attenuate at least the first overtone of the fundamental frequency.

6 Claims, 8 Drawing Sheets

NOISE REDUCED LIQUID SEALED COMPRESSOR

The present invention relates to the reduction of noise produced by a liquid sealed rotary compressor under normal operating conditions.

BACKGROUND OF THE INVENTION

Liquid sealed rotary compressors have been in common use for many years. Such compressors are simple in design, are readily manufactured, and are well suited for continuous duty applications.

Because these devices usually incorporate a high speed rotor having numerous vanes, and inasmuch as they operate at constant speed, it is typical in such units in such devices produce a significant high frequency tone which is unacceptable or undesirable in many applications. Historically, uses of these devices have employed reactive type, tuned silencers on either the input conduit or output conduit, or both, to reduce the noise level. The need for silencers is balanced against the cost and the available space permitted for such devices. In addition, the silencers frequently employed are much less than optimal, inasmuch as they are not specifically designed to filter the frequencies produced by the specific compressor configuration while minimizing the pressure drop involved.

Accordingly, a primary object of the present invention is to provide unique silencers as part of a port and manifold assembly, which is integrated with a compressor device, so as to enable optimal silencing precisely because such silencers are specifically designed to filter the frequencies produced by the specific compressor configuration.

In realizing the primary object stated above, the primary feature of the present invention resides in the provision of configuring the intake and output manifold geometries in such a fashion as to create a pair of separate broad banded reactive filters integral to both the internal input manifold and the internal output manifold.

An ancillary objective is to achieve this configuration within the existing volume envelope typical of known compressors not so equipped. Such volume envelope of currently designed compressors is a cylindrical shape 17" long and 7" in diameter. Any product designed to serve this market must not exceed these dimensions.

A further object is to produce a more complete noise reduction scheme by locating the reactor silencers directly at the source of the noise.

Yet another object is to achieve a design which is more cost effective than is the addition of external silencers.

Other objects are to achieve a design which eliminates the need for additional space to accommodate external silencers; to produce a compressor which is inherently quiet and thus is more attractive in the marketplace; and, further, to produce a compressor so equipped and configured that it may be installed and operated effectively in most applications in which a conventional compressor of similar performance levels has been deployed.

The inventor's Assignee, Dielectric Communications of Raymond, Maine, a division of General Signal Corp., has been manufacturing a line of water sealed air compressors since the mid sixties. These compressors are used almost exclusively by the telephone industry to produce compressed air at pressures ranging up to approximately 30 PSIG. This compressed air is dried by special dryer systems, and is then introduced into telephone cables under pressure to prevent the intrusion of water into those cables. The compressors are typically packaged as an internal component in a compressor-dehydrator unit also manufactured by Dielectric.

The above noted compressor-dehydrators are frequently located in structures which are also the workplace of telephone company employees. Often several compressors will be operating simultaneously (for example, in one office in Manhattan there are thirty such compressors in one room), such that the deleterious noise effects are substantial.

It should be noted that the compressors common to this specific market range in sizes up to 5 hp, and they are always mounted directly to their associated motor and produce air at flow rates up to 25 SCFM at 25 PSIG. At present, none of the manufacturers supplying compressors of this general specification have envisioned or employed reactor silencers internal to the compressor structure. Accordingly, it is to this market that the present invention is directed and it will be apparent that such a quiet compressor could very likely become the industry standard replacing all other devices of like purpose in competitive compressor-dehydrators.

SUMMARY OF THE INVENTION

In fulfillment of the above stated objects, as well as other objects, a primary feature of the present invention provides, within an otherwise conventionally designed port and manifold assembly, a special geometry or configuration for the intake and output manifold so as to create a separate, broad banded, reactive filter from both the internal input manifold and the internal output manifold. Thus, in the preferred embodiment the reactive silencers are fabricated internal to the "port and manifold assembly". The resonant cavities, which are preferably four in number but can be reduced to two, one on the input and one on the output, follow the general design outlined in Bareneck, L. L., Noise And Vibration Control, McGraw Hill Book Co. Inc., New York, 1971, Chapter 12, in which there is described on Page 369, a dual chamber muffler in which the chambers are connected by means of a passage of length equal to that of the cavities and so located as to extend half way into each of the two cavities. This configuration is most desirable for the present application because of its demonstrated ability to attenuate all frequencies over a wide band as illustrated in FIG. 12.5 in the Bareneck work.

Accordingly, the preferred embodiment of the present invention as noted above comprises two sets of dual resonant cavities tuned to the first overtone of the fundamental tone or frequency naturally produced by a given compressor. The calculation of this frequency is relatively simple based on the motor speed in RPM divided by 60 seconds per minute, times the number of blades in the rotor, thereby giving the fundamental frequency. For the compressors manufactured by the inventor's Assignee, this is 1035 Hertz (cycles per second). The wave length of the fundamental is obtained by dividing the velocity of sound (1150 ft. per second) by the fundamental frequency times 12 inches per foot. For the pumps or compressors under consideration what you have is 13.33 inches. However, to design mufflers tuned to the fundamental would require a pair of cavities one-quarter wave length or 33.33 inches long. This limited length exceeds the space available in the standard compressor envelope under consideration.

It has been found by the present inventor that through analysis of the data presented in the aforesaid FIG. 12.5 of Bareneck, that a muffler of such design optimized at the first overtone (twice the compressor frequency, one half the wave length) not only attenuates the said overtone, but also provides significant attenuation at the fundamental. Therefore, the design of the present invention is based on optimizing the configuration with respect to the first overtone, and yet gaining the advantage of significant attenuation at the fundamental. Moreover, this optimal configuration also provides significant attenuation of the higher overtones, which are typically prominent in the noise generated by said compressors, and in most applications are the most distressing sounds produced.

Accordingly, the criteria :newly designed cavity is that a length of approximately 1.67 inches, one half of the above noted one-quarter wave length of 3.33 inches. However, this would allow for only one cavity to be built on the front of the compressor without exceeding the typical envelope. Therefore, the inventor chose to modify the Bareneck configuration to allow for two cavities to be constructed side by side and connected by a passage which is preferably folded in the middle. Such overall configuration will become apparent as the disclosure proceeds. With such folded configuration it is possible to convert a manifold to include a silencer while remaining inside the typical envelope.

Briefly defined then, the noise reduced, liquid sealed compressor of the present invention comprises a rotary compressor to which is connected a port and manifold assembly having input and output manifolds, including respective input and output ports, and further comprising at least one reactive muffler or silencer formed in the body of said assembly and coupled with at least one of said input and output manifolds, said muffler or silencer including a pair of cavities within the assembly connected by a passage, which cavities are to attenuate the first overtone of the fundamental frequency of the compressor, whereby significant noise reduction is attained.

Other and further objects, advantages and features of the present invention will be understood by reference to the following specification in conjunction with the annexed drawings, wherein like parts have been given like numbers.

DESCRIPTION OF PREFERRED EMBODIMENT

Figure 1:
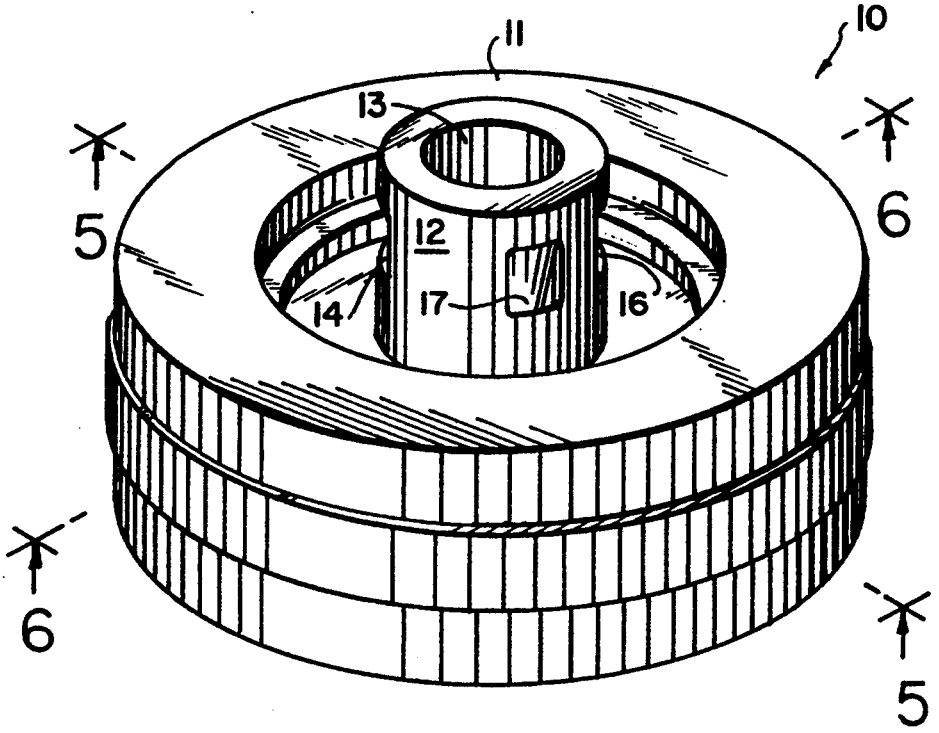
FIG. 1 is a rear perspective view of the preferred embodiment of the port and manifold assembly of a noise reduced compressor in accordance with the present invention.
Figure 2:
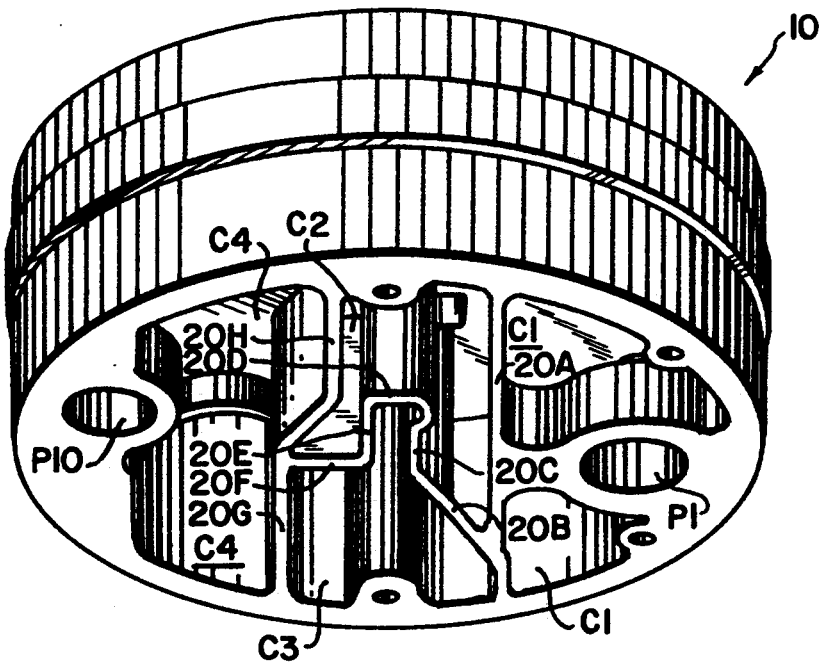
FIG. 2 is a front perspective view of said assembly.
Figure 3:
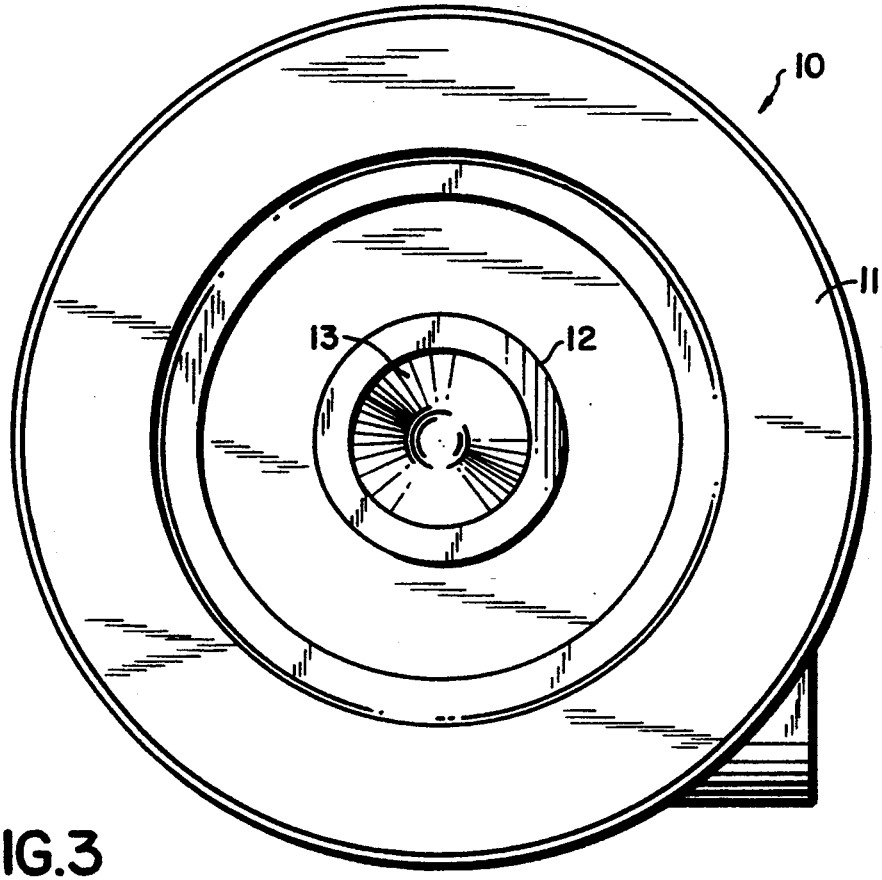
FIG. 3 is a rear elevation of said assembly.
Figure 15:
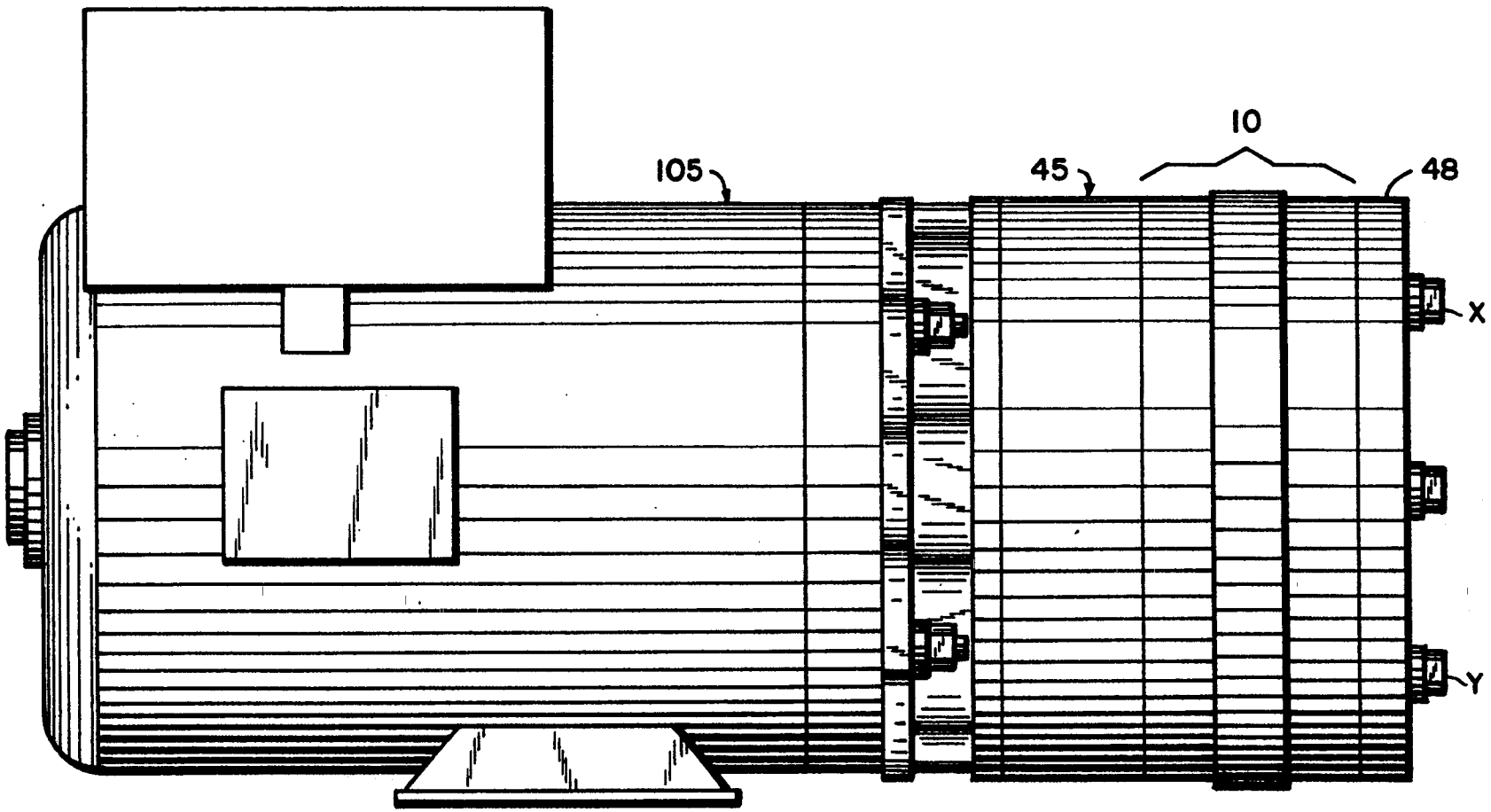
FIG. 15 is a side elevation view depicting the compressor context in which the present invention is disposed.

The preferred embodiment of the invention in its compressor context is seen in FIG. 15, in which the compressor assembly is comprised of a motor assembly 105, a housing 45, a rotor (not seen, being internal to housing 4.5). Referring to FIG. 1, the porting and manifolding head 10, per se, is seen; and a port sleeve (not seen) as well as shaft seals, and other necessary mechanical and electrical components are provided to create an operative device. The port and manifold assembly or head 10, per se, contains the novel feature to be described here; it is this assembly in which the preferred embodiment of the noise reduction means of the invention is embodied.

Details of the port and manifold assembly, or so called "Quiet Head", are found in FIGS. 1-14. This device has a number of more or less conventional functions:

(1) It serves as the point of interface with the user air system via tile input port X and the output port Y located in the cover 48;

(2) It serves to manifold the input air stream from the input port X to tile two ports labeled 14 and 16 (FIG. 1) which feed air via the central porting column 12 to the port sleeve input ports through which air enters the spinning rotor;

(3) It serves to manifold the high pressure air leaving the rotor via tile port sleeve output ports (themselves leading directly via the central porting column 12 having the output ports labeled 17 and 15) to the output port Y;

(4) It contains a bypass adjustment which is used to establish the exact output flow rate and compensate for production variations;

(5) It provides a drain passage to the compressor housing 45, through which the cavity containing the rotor can be drained of water prior to shipment or maintenance. The output of this passage is terminated by a fitting 4, and plug.

These above noted five functions are conventional and are not the subject of this invention. The following function is new and will be the subject of further description. It provides by virtue of tuned cavities, passages, and baffles, all integral to the manifolding configuration a reduction of compressor noise being transmitted along the input and output air streams.

The port and manifold assembly 10 of the compressor has formed within it the noise reducing cavities to be described and designated by the letter C. Additionally provided are passages designated by use of the letter P, and baffles by the letter B.

The cavities already referred to are four in number in the preferred embodiment and are designated C1, C2 (input), and C3, C4 (output) and they are formed within the 6.75 diameter envelope, their design subject to the following criteria.

Figure 4:
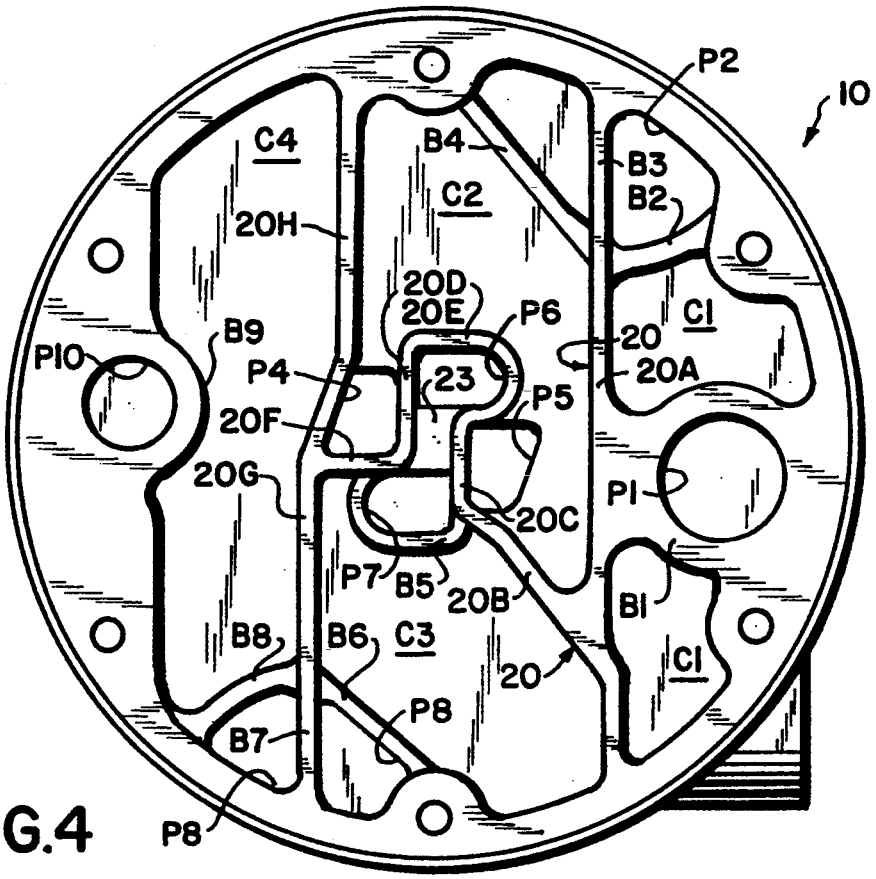
FIG. 4 is a front elevation view of the assembly.
Figure 5:
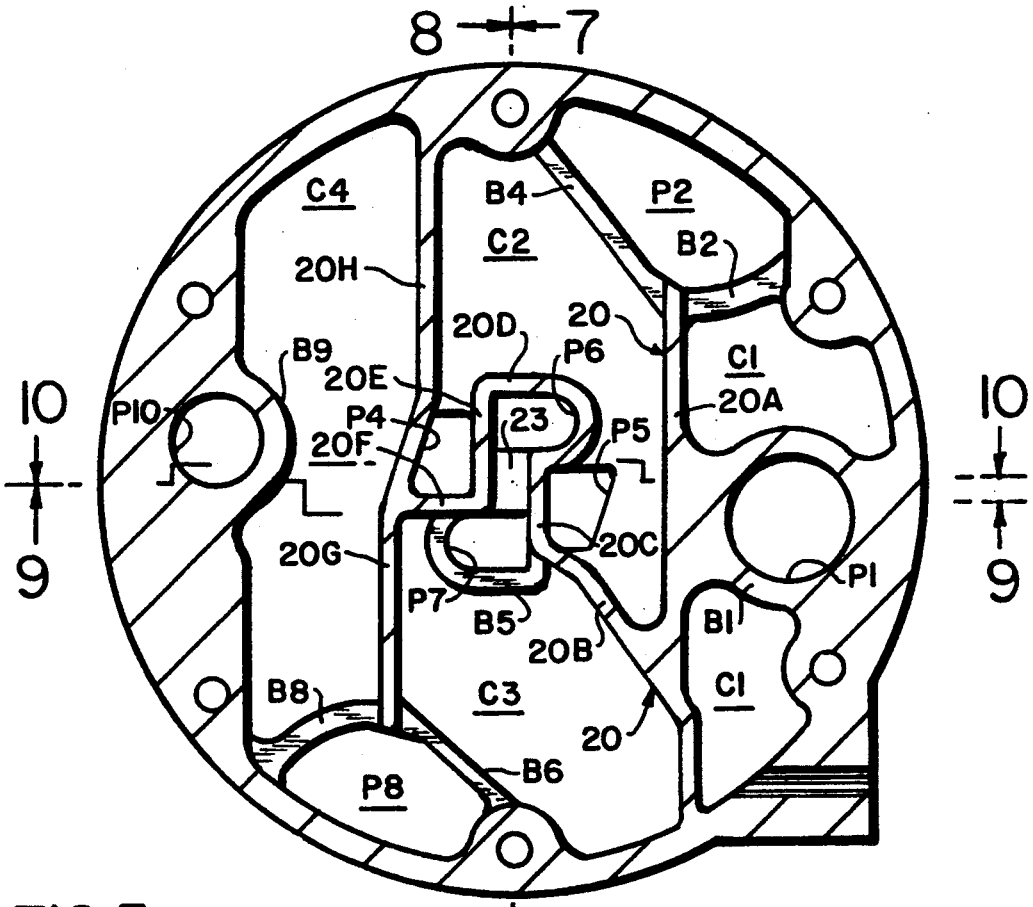
FIG. 5 is a horizontal sectional view taken on the line 5—5 seen in FIG. 1.
Figure 6:
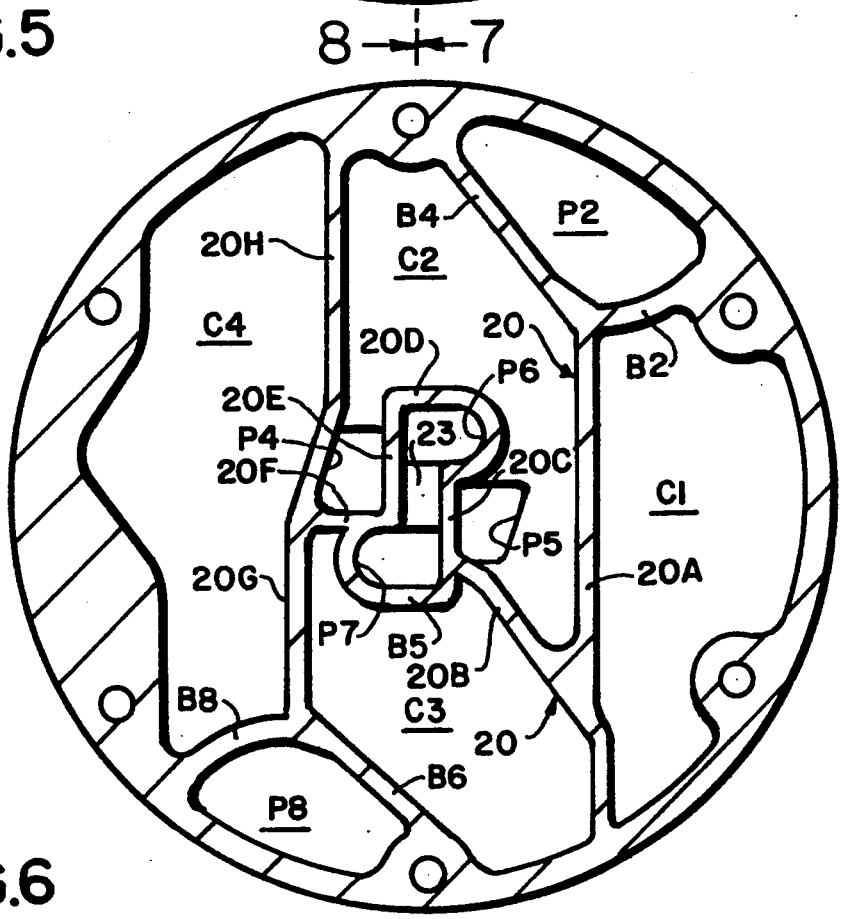
FIG. 6 is a horizontal sectional view taken on the line 6—6 seen in FIG. 1.
Figure 7:
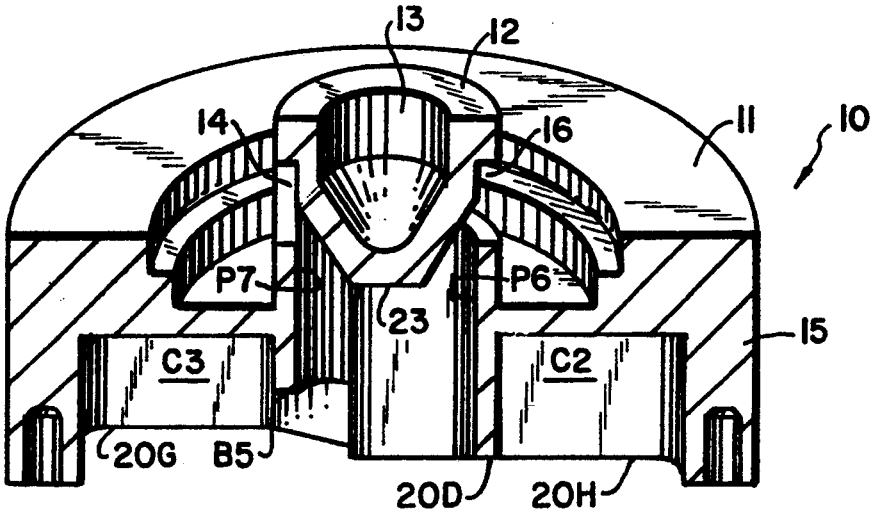
FIG. 7 is a vertical sectional view taken on the line 7—7 seen in FIG. 5.
Figure 8:
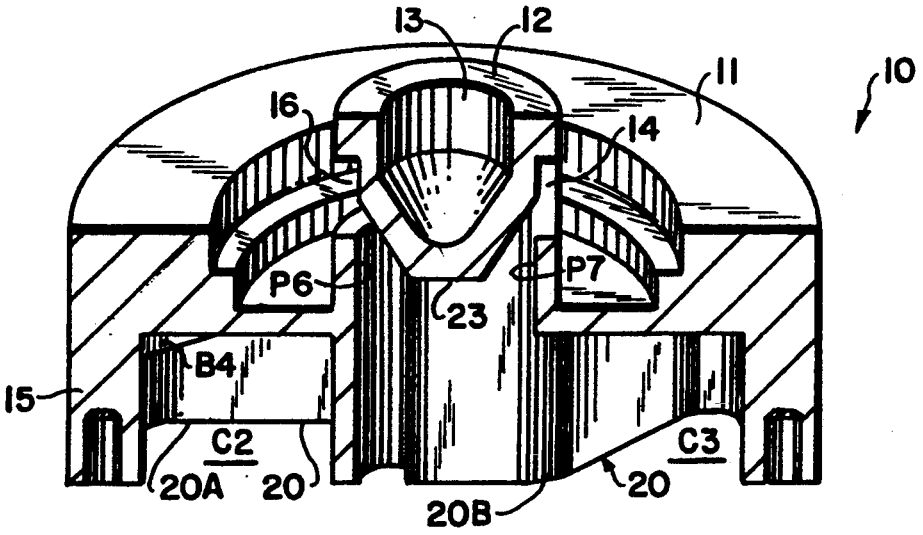
FIG. 8 is a vertical sectional view, opposite to that of FIG. 7, and taken on the line 8—8 in FIG. 5.
Figure 9:
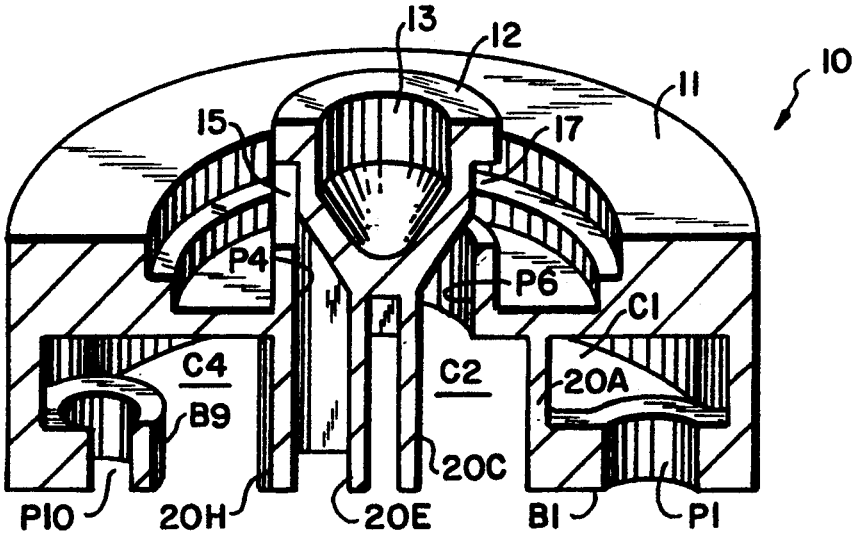
FIG. 9 is a vertical sectional view taken on the line 9—9 in FIG. 5, which is 90° from the sectional view of FIG. 7.
Figure 10:
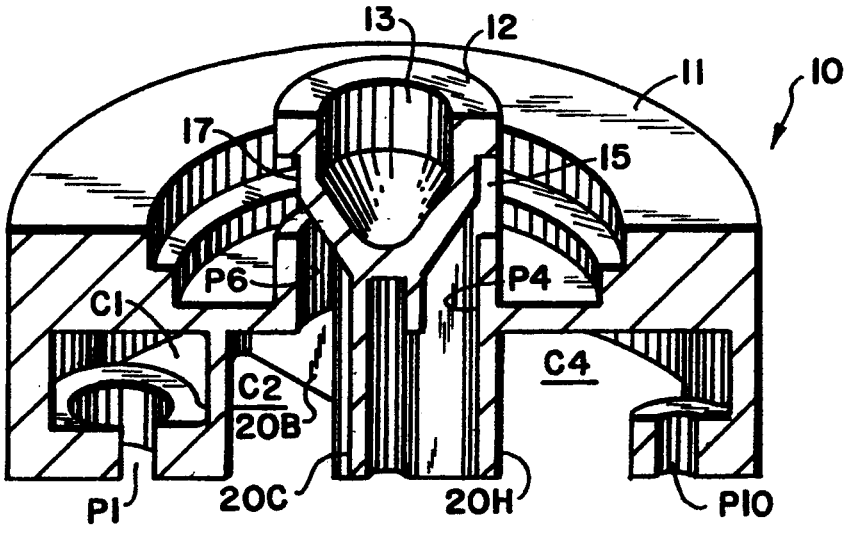
FIG. 10 is a vertical sectional view taken on the line 10—10 in FIG. 5, such view opposite or 180° displaced to the view of FIG. 9.
Figure 11:
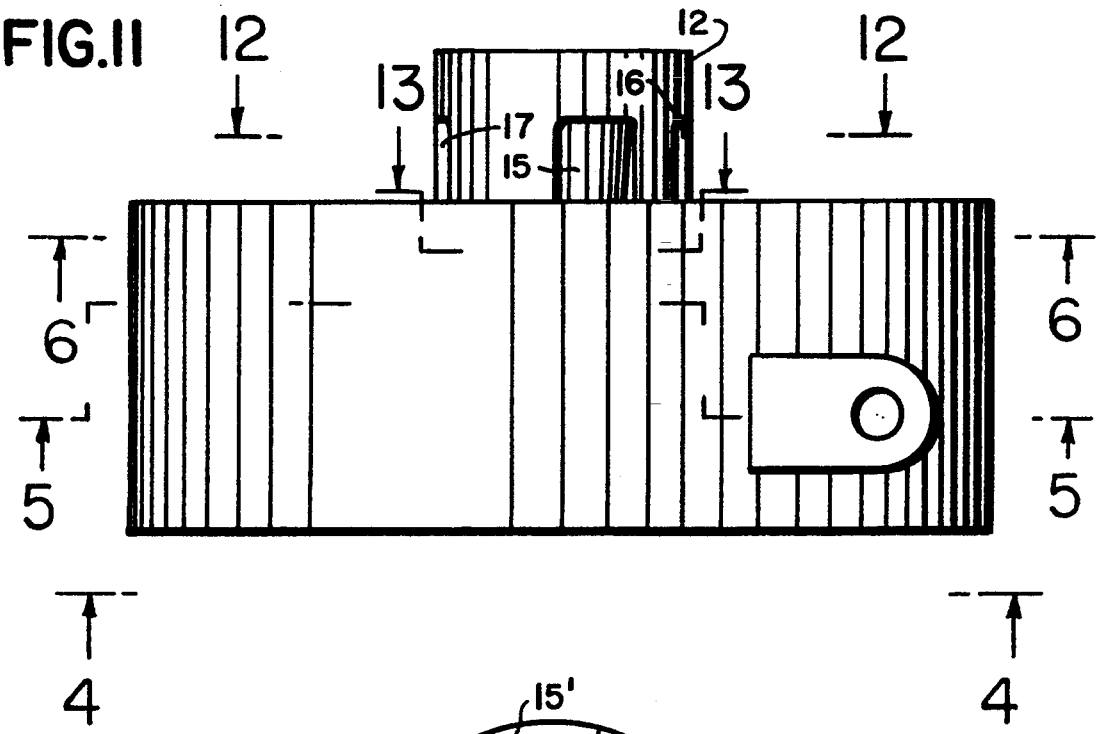
FIG. 11 is a side elevational view of the port and manifold assembly of the compressor.
Figure 12:
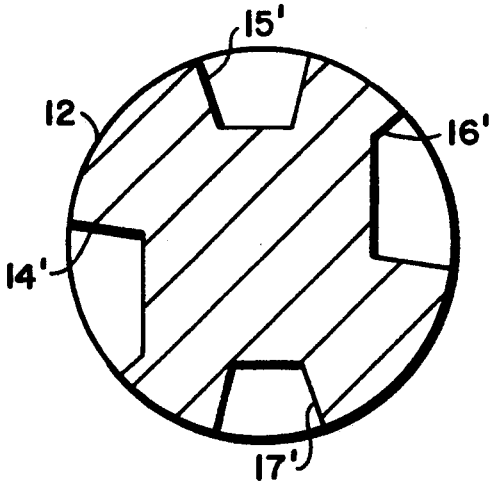
FIG. 12 is a partial sectional view taken on the line 12—12 of FIG. 11.
Figure 13:
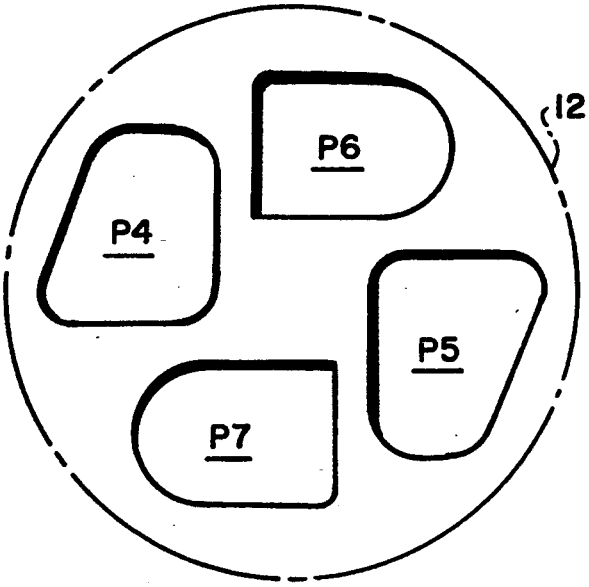
FIG. 13 is a partial sectional view taken on the line 13—13 of FIG. 11.

The four cavities C1–C4 are irregular right cylinders having a height of approximately 1.68 inches and having approximately equal base areas (see particularly FIG. 4). The bases of the four irregular right cylinders thus divide the 6.75 inch diameter envelope into four approximately equal parts. The division is accomplished in such a way that the irregular base contours of the cavities have nearly equal areas.

The four cavities, together with their interconnecting porting must be so arranged that liquid water will not accumulate in any portion of the four cylindrical cavities when the c compressor is positioned in its normal operating orientation. Moreover, liquid water entering through the input passage P1 (see again FIG. 4, in which a cover normally in place has been removed) should it enter the first input cavity C1 on the input stream, must flow freely due to gravity from the first to the second input cavity C2 and into the compressor rotor intake passage P4 and P5 located on the centrally position porting column (axis). Liquid water exiting the compressor from the rotor exhaust ports P6 and P7 on the centrally located porting column must similarly flow freely due to gravity from the first output cavity C3 to the second output cavity C4 and out through the output passage P10.

When viewed by turning the sheet on which FIG. 4 appears 90° counterclockwise, it will be seen that the first input cavity C1 on the input stream is provided with a baffle B1 approximately 0.84 inches high, i.e., extending axially approximately half way into the first cavity C1, for optimal acoustic de-coupling of the undesirable compressor tones as they attempt to pass along in the direction of the input plumbing. The output passage P10 is similarly baffled, involving baffle B9 acting to provide optimal acoustical de-coupling of the undesirable compressor tones or frequencies as they pass along in the axial direction of the output plumbing.

The first and second input cavities C1 and C2 are connected by a folded passage P2, which is defined by the baffles B2, B3 and B4, which extend approximately 0.84 into the cavities, in sequentially opposite ways, so as to control air flow from the one cavity to the other as indicated by the arrow. The axial extent of each baffle is approximately half the cavity height. Such baffling provides optimal acoustical de-coupling, as noted previously, of the undesirable compressor frequencies from one cavity to the next. The specific arrangement can be seen particularly in FIG. 4 in which, for example, baffle B2 extends laterally between a wall 20 and the envelope 15. Wall 20 extends axially or longitudinally so as completely to isolate input cavities C1 and C2, except for the judiciously configured baffling which permits flow through passage P2. The further baffles B3 and B4 are also seen adjacent baffle B2 in FIG. 4.

Diagonally opposite to this location is a similar arrangement of baffles B6, B7 and B8 functioning to provide baffling for the air flow from output cavity C3 to output cavity B4. The corresponding output passage P8 is defined by these baffles in similar fashion. Air is exhausted from the output cavity C4 by means of the passage P10 to the users system, said passage P10 being defined by another baffle B9.

It will be understood that the cross sectional area of the input passage P2, as well as the output passage P8 at the diagonally opposite location from P2, are both chosen such that these passages remain approximately equal to that of the input and output plumbing, respectively. Thereby, they minimize air flow restriction so as to minimize air flow resistance.

Figure 14:
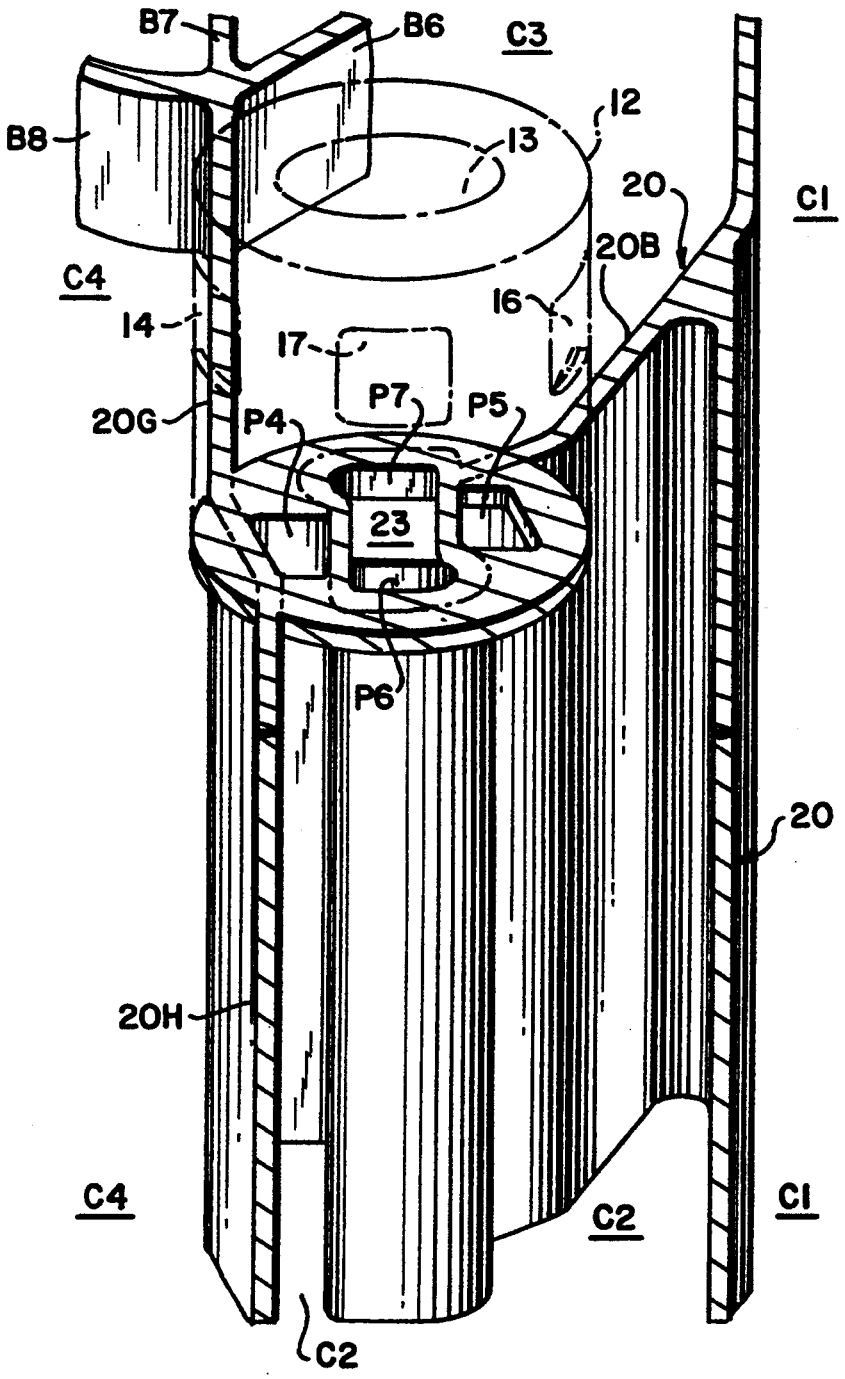
FIG. 14 is an enlarged vertical perspective view of the port and manifold assembly.

By reference to the several figures and particularly to FIGS. 4 and 14 (the latter being a fragmentary perspective view of the device), it will be apparent that the wall 20 previously noted is a fixed, unbroken wall of irregular configuration, and the several portions thereof, i.e., 20A, 20B, 20C, 20D, 20E, 20F, 20G, 20H are seen to define a central porting column, such arrangement being, more or less, conventional in the art, such wall portions defining at least in part the several centrally located passages P4, P5, P6 and P7, the first two being rotor input passages with respect to the air flow from cavity C2. P6 is also defined by the portion 20D of the wall 20 and this is a rotor output passage which communicates with passage 7 such that air flow is outward into the output cavity C3. The output rotor passage P7 also located on the central porting column, is equipped with a baffle B5 (see FIG. 4) whereby the output stream P7 enters the output cavity C3. As before, this baffle B5 likewise extends approximately 0.84 inches into C3 to acoustically de-couple the undesirable compressor frequencies as they enter C3 and to establish the orientation of cavity acoustical excitation.

A machined prototype of the dual resonator configuration was constructed and tested for performance on Friday, Feb. 7, 1992. Two identical 1.5 hp compressors were constructed, one with the silencers and one without. The unit equipped with the silencer system measured 61 db at 3 ft., while the unit not so equipped measured 69 db. This indicates that approximately 80% of the acoustical energy was eliminated by the silencer system. It is not possible to measure the noise level completely independent of the test equipment because the output of the compressor must be elevated in pressure to its operating level. For this reason, the tests were conducted with the compressors installed in their typical working environment inside a standard cabinet with the front door removed and the cooling fans off. Were tests to be run without standard silencing, the noise level would be dangerously high (greater than 120 db). The noise level reduction achieved may, for example, be compared to reducing the sound of a washing machine in the spin cycle to that of a refrigerator, that is, from a sound which is irritating to a sound that is near or below background noise. In addition, the noise was noticed subjectively to be significantly less distressing because of the near absence of the higher overtones, in fact, much of the remaining noise was motor related rather than compressor related. Similar results were demonstrated when the prototype silencer was installed on a larger compressor of about 3.5 hp.

In production, the entire port and manifold assembly of the present invention is cast of aluminum to include the central porting column, the four cavities and all the above mentioned baffles. The casting is machined to finish dimensions and then treated with a Military Spec. hard coat and a Teflon® impregnation to eliminate electro-chemical, and abrasive deterioration of the head. A flat cover (not seen) of hard coated aluminum is then installed using a double sided industrial adhesive film as gasket. The cover is fastened with two dedicated 5/16" bolts and four more 5/16" which fasten the port and manifold assembly to the compressor housing further secure the cover to the casting.

While there has been shown and described what is considered at present to be the preferred embodiment of the present invention, it will be appreciated by those skilled in the an be limited to this embodiment, and it is intended to cover in the appended claims all such modifications as fall within the true spirit and scope of the invention.

What is claimed is:

1. A noise reduced, liquid sealed compressor comprising:

a rotary compressor body, including a port and manifold assembly having input and output manifolds, and respective input and output ports;

a pair of reactive silencers integrally formed within said port and manifold assembly, and coupled acoustically with said respective input and output manifolds;

said silencers each including a pair of resonant cavities connected by a passage, said cavities being configured to attenuate at least the first overtone of the fundamental frequency of the compressor, whereby significant noise reduction is attained.

2. A device as defined in claim 1, in which each said passage is folded.

3. A device as defined each in claim 1, in which a plurality of baffles define said passage.

4. A port and manifold assembly for incorporation into a liquid sealed compressor comprising:

input and output manifolds, and respective input and output ports;

a pair of reactive silencers integrally formed within said port and manifold assembly and coupled acoustically with said respective input and output manifolds;

said silencers each including a pair of resonant cavities connected by a passage, said cavities being configured to attenuate at least the first overtone of the fundamental frequency of the compressor, whereby significant noise reduction is attained.

5. A device as defined in claim 4, in which each of said silencers is comprised of a pair of cavities of equal axial length and approximately equal cross sectional area coupled by means of a passage of axial length equal to that of the cavities and extending one half its length into each cavity, the orientation of acoustical resonance of the two cavities and the passage being aligned one to the next.

6. A device as defined in claim 5, wherein said passages are folded 180° at the midpoint to facilitate the side by side arrangement of said cavities without loss of acoustical function.

* * * * *